US008475034B2

(12) United States Patent
Hillis

(10) Patent No.: US 8,475,034 B2
(45) Date of Patent: Jul. 2, 2013

(54) ENHANCED COMPOUND PENDULUMS AND SYSTEMS

(75) Inventor: W. Daniel Hillis, Encino, CA (US)

(73) Assignee: The Long Now Foundation, San Francisco, CA (US)

( * ) Notice: Subject to any disclaimer, the term of this patent is extended or adjusted under 35 U.S.C. 154(b) by 697 days.

(21) Appl. No.: 12/695,926

(22) Filed: Jan. 28, 2010

(65) Prior Publication Data

US 2010/0128574 A1 May 27, 2010

Related U.S. Application Data

(60) Continuation-in-part of application No. 12/274,240, filed on Nov. 19, 2008, now abandoned, which is a division of application No. 11/734,751, filed on Apr. 12, 2007, now abandoned.

(60) Provisional application No. 60/744,722, filed on Apr. 12, 2006.

(51) Int. Cl.
*G04B 17/22* (2006.01)

(52) U.S. Cl.
USPC ..... 368/182; 368/179

(58) Field of Classification Search
USPC ..... 368/179–183
See application file for complete search history.

(56) References Cited

U.S. PATENT DOCUMENTS

| | | | | |
|---|---|---|---|---|
| 1,951,995 | A | 3/1934 | Schaad | |
| 2,746,238 | A | 5/1956 | Stamm | |
| 3,052,084 | A | 9/1962 | Widmer | |
| 3,318,087 | A | 5/1967 | Favre | |
| 3,491,530 | A | 1/1970 | Tilse | |
| 3,548,586 | A | 12/1970 | Klinck | |
| 4,378,166 | A * | 3/1983 | Itami et al. | 368/134 |
| 4,449,831 | A | 5/1984 | Itami et al. | |
| 5,886,956 | A | 3/1999 | Fiedler | |
| 6,354,731 | B1 | 3/2002 | Halter | |
| 6,686,807 | B1 | 2/2004 | Giousouf et al. | |
| 7,726,872 | B2 * | 6/2010 | Levingston | 368/175 |
| 8,100,579 | B2 * | 1/2012 | Levingston | 368/171 |
| 2005/0088919 | A1 | 4/2005 | Frey | |
| 2007/0140065 | A1 * | 6/2007 | Levingston | 368/127 |
| 2010/0034057 | A1 * | 2/2010 | Levingston | 368/175 |

OTHER PUBLICATIONS

Internet Archive; web.archive.org/web/*/htpp://www.phy.davidson.edu/StuHome/derekk/Resonance/pages/pendulum.htm: Dec. 13, 2007.

Pendulum:phy.davidson.edu/StuHome/derekk/Resonance/pages/pendulum.htm: Jul. 2, 2003.

* cited by examiner

*Primary Examiner* — Sean Kayes
(74) *Attorney, Agent, or Firm* — Michael A. Glenn; Glenn Patent Group

(57) ABSTRACT

Enhanced compound pendulums provide thermal compensation and/or barometric compensation, such as for a mechanical clock system. The enhanced compound pendulums are simple to construct, and can be more easily compensated than conventional, single-bob pendulums. The enhanced compound pendulums typically comprise material that is added above the point of rotation. Thermal expansion factors for components of the enhanced compound pendulums may preferably be chosen to provide thermal compensation to the first order. In some embodiments of enhanced compound pendulums, volume is added above the pivot to provide barometric compensation, such as by equalizing the moments above and below the pivot, or by providing geometric symmetry above and below the pivot, with a lower density above the pivot.

10 Claims, 9 Drawing Sheets

ENHANCED COMPOUND PENDULUMS AND SYSTEMS

CROSS REFERENCE TO RELATED APPLICATION

This application is a Continuation-in-Part of U.S. patent application Ser. No. 12/274,240, filed 19 Nov. 2008, which is a DIVISIONAL application of U.S. patent application Ser. No. 11/734,751, filed 12 Apr. 2007, which claims benefit to U.S. Provisional Application No. 60/744,722, filed on 12 Apr. 2006, which are incorporated herein in their entirety by this reference hereto.

BACKGROUND OF THE INVENTION

1. Technical Field

The invention relates to time keeping devices. More particularly, the invention relates to enhanced compound pendulums that can be thermally and/or barometrically compensated, such as for a mechanical clock.

2. Description of the Prior Art

Historically, the gravity pendulum has been the most successful device for accurately regulating the timing of a mechanical clock. The frequency of such a simple pendulum is approximately proportional to the square root of the ratio of earth's gravity to length of the pendulum ($f=2\pi\sqrt{l/g}$). Because the force of gravity is reasonably constant, keeping the period constant is largely a matter of keeping the length constant, which can be accomplished by careful selection of the materials and geometry, while paying special attention to expansion due to changes in temperature.

While an idealized pendulum has all of its mass concentrated at a point, real pendulum are actually a compound pendulums, with a distributed mass. In general, a compound pendulum has a longer period than a corresponding idealized pendulum, because of the extra moment of inertia contributed by the distribution of the mass.

Another potential accuracy problem of a gravity pendulum is that the period of the swing actually depends slightly on the amplitude. The frequency formula mentioned above is based on the assumption that the restoring force created by gravity is proportional to the angle of the bob from vertical, which is only an approximation. Actually, the restoring force is proportional to the sine of that angle. This difference is small as long as the angle is small, but to hold the frequency constant, the average amplitude of the swing must also be held constant.

Friction creates most of the difficulties in holding constant amplitude. While the greatest source of friction is often the pendulum motion through the air, there is also friction in the unlocking of the escapement, as well as friction in the suspension. Each of these sources of friction is variable. Also, the existence of any type of friction requires that energy be put back into the pendulum, to keep the pendulum going. This impulsion of the pendulum can be a major source of variability, because it is difficult to deliver the exact same impulse on each tick.

Another source of the error in a pendulum is the variation of the density of air, which changes the buoyancy of the bob. Because some of the weight of the bob is supported by floating in the surrounding air, the restoring force of gravity varies with the density. Because the density of the air depends on the barometric pressure, variations in pressure contribute to variability in, the rate of the pendulum.

Eliminating air around the pendulum can reduce several sources of variability because, while air is not only the source of the variable density problem, air is also the source of much of the friction. For this reason, most accurate clock pendulums at this time are operated in a partial vacuum.

It would be advantageous to provide a pendulum that has some of the same advantages, but without the complexities of maintaining a partial vacuum.

It would also be advantageous to provide a pendulum that has thermal compensation and/or barometric compensation, that is simple to construct, and that is more easily compensated than a conventional, single-bob pendulum.

SUMMARY OF THE INVENTION

Enhanced compound pendulums provide thermal compensation and/or barometric compensation, such as for a mechanical clock system. The enhanced compound pendulums are simple to construct, and can be more easily compensated than conventional, single-bob pendulums. The enhanced compound pendulums typically comprise material that is added above the point of rotation. Thermal expansion factors for components of the enhanced compound pendulums may preferably be chosen to provide thermal compensation to the first order. In some embodiments of enhanced compound pendulums, volume is added above the pivot to provide barometric compensation, such as by equalizing the moments above and below the pivot, or by providing geometric symmetry above and below the pivot, with a lower density above the pivot.

DETAILED DESCRIPTION OF THE INVENTION

Figure 1:
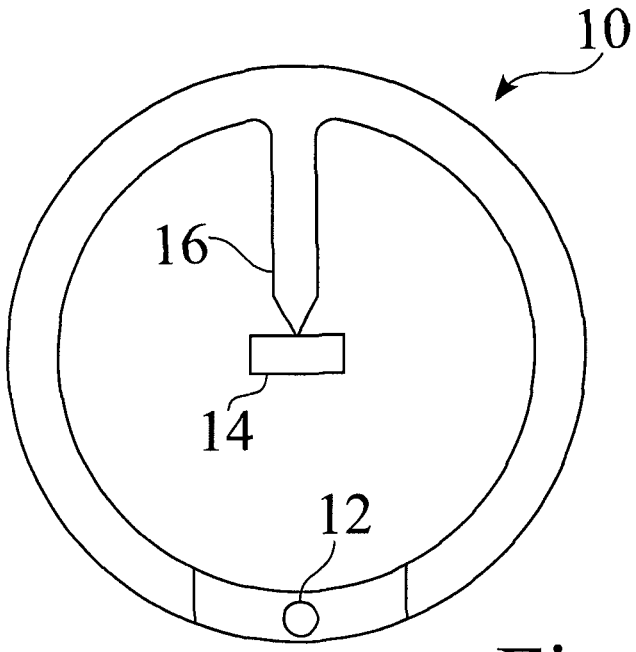
FIG. 1 is a side view showing a spoke up configuration of a low displacement pendulum having a knife-edge bearing, where a portion of the pendulum ring is made of a higher density material.

Some embodiments of the invention provide a new form of gravity pendulum, which is referred to as a low-displacement pendulum, because it displaces less air as it rotates. The low-displacement pendulum uses an unbalanced wheel instead of the more conventional suspended bob. Because the pendulum displaces less air as it rotates, it eliminates an important component of air drag that causes energy loss in a normal pendulum. The low-displacement also eliminates errors caused by variations in barometric pressure. In addition, it can be easily thermally compensated without the use of special materials, such as Invar.

A key aspect of a low-displacement pendulum is the use of an unbalanced wheel instead of a suspended bob. The unbalance can be accomplished by increasing the amount or density of material in the lower part of the wheel or by decreasing density in the upper part of the wheel. Because a wheel is symmetric about its center of rotation it does not displace air as it rotates. This eliminates a major component of aerodynamic drag, referred to as form drag, leaving only the skin drag caused by sheer in the boundary layer. The lack of displacement also eliminates rotational forces that are caused by buoyancy and which vary with barometric pressure.

The wheel of a low-displacement pendulum may be a full disk, but the inertia per weight can be increased by thinning the center of the pendulum, putting most of the mass in a thin ring around the edge. The mass farther from the center contributes most to the inertia of the wheel. Thus, this lightens the mass required to achieve a given inertia. The skin drag can be reduced by replacing the center hub with one or more spokes between the ring and the center support suspension. If these spokes are placed symmetrically across from each other, the low-displacement property of the pendulum is preserved. In any case, the displacement of the spoke or spokes is small.

The use of spokes creates some additional air drag. This can be minimized by streamlining the shape of the spoke by keeping the cross-section small, and by keeping the number of spokes to a minimum. If a single spoke is used, it can either be above the center, in compression, or below the center, in tension. Which configuration is best depends upon specific details, such as the choice of materials and type of suspension. Materials, such as glass and ceramics, are often much stronger in compression, favoring the spoke-up configuration. Flexible materials, such as metal, may tend to buckle, favoring the spoke-down configuration. The spoke-down configuration is also particularly simple because it uses a flexure bearing, whereas a spoke-up configuration is very simple because it uses a knife-edge suspension.

A Slower Swing

The low-displacement pendulum is a type of compound pendulum. Accordingly, it swings more slowly than a conventional pendulum of the same length. This can be used to advantage in further reducing air drag, which depends on the velocity of the pendulum. In a simple pendulum, the period is determined by the length because both the inertia and the restoring force scale together with the mass, but in a compound pendulum these two factors need to be controlled independently. In the low-displacement pendulum, the degree of imbalance, which controls the restoring force, can be made arbitrarily small. This allows the period to be increased without changing the length.

For a thin ring, if the distance from the center of rotation to the center of gravity is h, and the radius of the ring is r, then period of the pendulum is:

$$\text{period} \approx 2\pi\sqrt{\frac{r^2}{gh}} \tag{1}$$

where g is the acceleration due to gravity, or expressed in terms of angular frequency:

$$\omega \approx \sqrt{\frac{gh}{r^2}} \tag{2}$$

Skin drag on an oscillating ring is proportional to area of the surface, the velocity, and to the square root of the viscosity and density of the medium and the frequency of the oscillation. The drag on a low-displacement pendulum of radius r, half-angle $\phi$, and angular frequency $\omega$ is:

$$\text{drag} = \frac{\text{area } r\phi\omega\sqrt{\mu\rho\omega}}{\sqrt{2}} \tag{3}$$

where $\mu$ is the viscosity and $\rho$ is the density of the medium, in this case air. Note that benefits to reducing the frequency of oscillation are better than linear. This means that the quality factor Q of the oscillator actually increases as the pendulum is made slower. This may seem counterintuitive because Q is sometimes expressed as frequency divided by damping factor, but in this case the damping factor goes down faster than the frequency. For a low-displacement pendulum:

$$Q = \sqrt{2}\,\frac{\text{mass}\omega}{\text{area}\sqrt{\mu\rho\omega}} \tag{4}$$

The above calculations neglect the drag due to the spokes, but they are small and streamlined, and are small compared to the drag of the ring.

There are also additional advantages of having the pendulum swing more slowly. One is that the gear train is simplified because there is less reduction required. Another is that less energy is required to keep the pendulum swinging. The impulse variability per unit time can be reduced if the impulses are delivered less often.

Temperature Compensation for Low Displacement Pendulums. If the pendulum undergoes thermal expansion, the period changes as specified by Equation (1) above. Changes in both r and h effect the period, but these two effects work in opposite directions. The period changes in proportion to r and in inverse proposition to the square root of h. This is because the increase in r increases the inertia of the pendulum, whereas increasing h increases the restoring force. If suitable materials are chosen for the spoke and the ring, the two effects can be made to cancel.

To achieve first-order temperature compensation in a single-spoke-system with a downward spoke, in tension, the coefficient of thermal expansion of the spoke must be slightly greater than that of the ring. Specifically, $$\beta_{down\text{-}spoke} = \beta_{ring}\left(1 + \frac{h}{r}\right) \tag{5}$$

This can be achieved by making a portion of the spoke out of material having a higher coefficient of expansion than the material of the ring. For example, if the ring is made of nickel or nickel copper alloy such as Monel™ it may be sufficient to make the suspension spring out of stainless steel or phosphor bronze, and the rest of the spoke from the same material as the ring. The exact proportion of spoke length that is made of the high-expansion material is determined by ratio of h to r.

In the case of an upward pointing spoke, the coefficient of thermal expansion of the spoke must be slightly lower than that of the ring. Specifically, $$\beta_{up\text{-}spoke} = \beta_{ring}\left(1 - \frac{h}{r}\right) \tag{6}$$

This can be achieved by making a portion of the spoke out of material having a lower coefficient of expansion than the material of the ring, e.g. such as but not limited to quartz.

Figure 2:
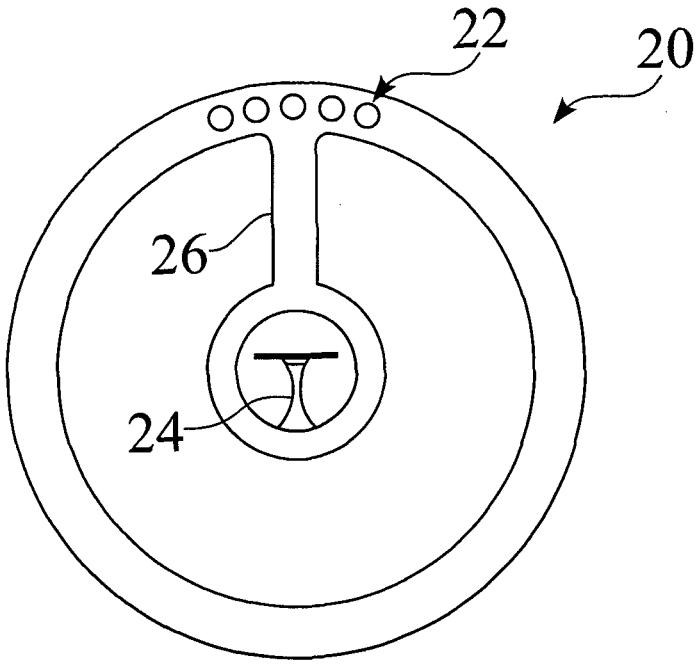
FIG. 2 is a side view showing a spoke up configuration of a low displacement pendulum having a suspension spring, where voids are formed in the pendulum ring to create imbalance.

Presently Preferred Embodiments of Low Displacement Pendulums. FIG. 1 is a side view showing a spoke up configuration 16 of a low displacement pendulum having a knife-edge bearing 14, where a portion 12 of the pendulum ring 10 is made of a higher density material. FIG. 2 is a side view showing a spoke up configuration 26 of a low displacement pendulum having a suspension spring 24, where voids 22 are formed in the pendulum ring 20 to create imbalance.

Figure 3:
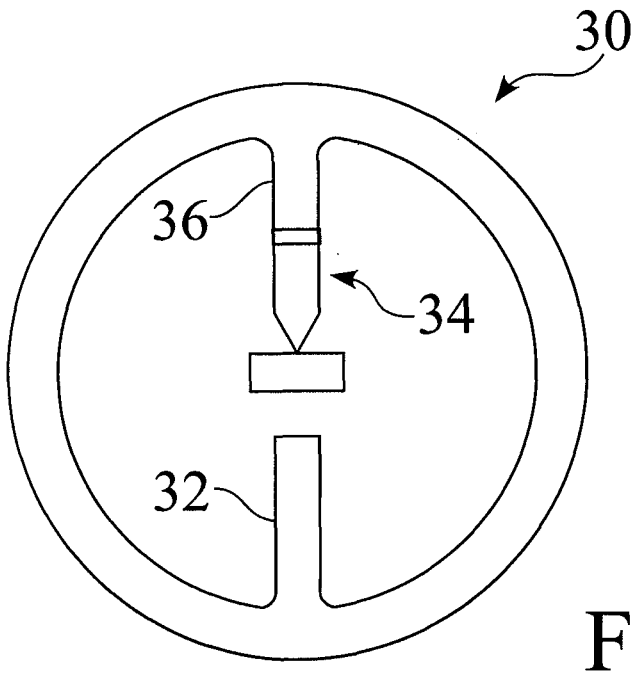
FIG. 3 is a side view showing a spoke up configuration of a low displacement pendulum having upward compensation, where a portion of the pendulum spoke is made of a lower expansion material, and where an optional false spoke is provided to preserve symmetry.

FIG. 3 is a side view showing a spoke up configuration of a low displacement pendulum having upward compensation, where a portion 34 of the pendulum spoke 36 is made of a lower expansion material, and where an optional false spoke 32 is provided to preserve symmetry of the pendulum ring 30.

Figure 4:
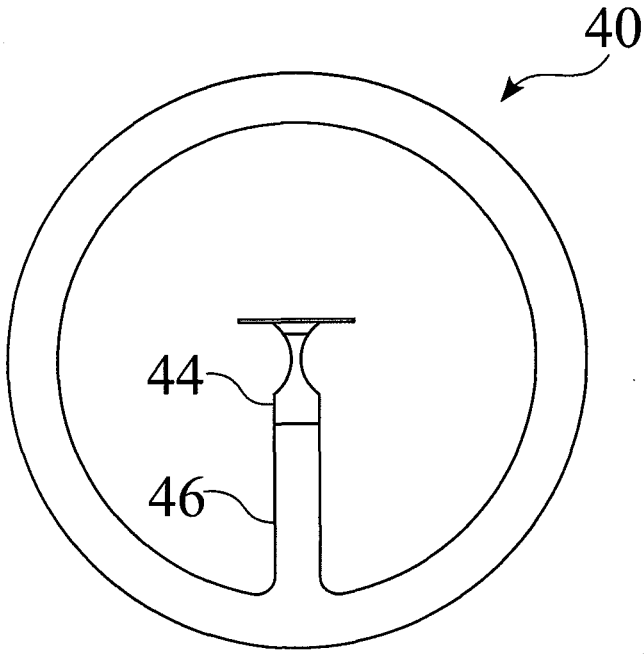
FIG. 4 is a side view showing a spoke down configuration of a low displacement pendulum having a suspension spring, where a pendulum spoke provides weight to create pendulum imbalance.

FIG. 4 is a side view showing a spoke down configuration of a low displacement pendulum having a suspension spring 44, where a pendulum spoke 46 provides weight to create pendulum imbalance in the ring 40.

Figure 5:
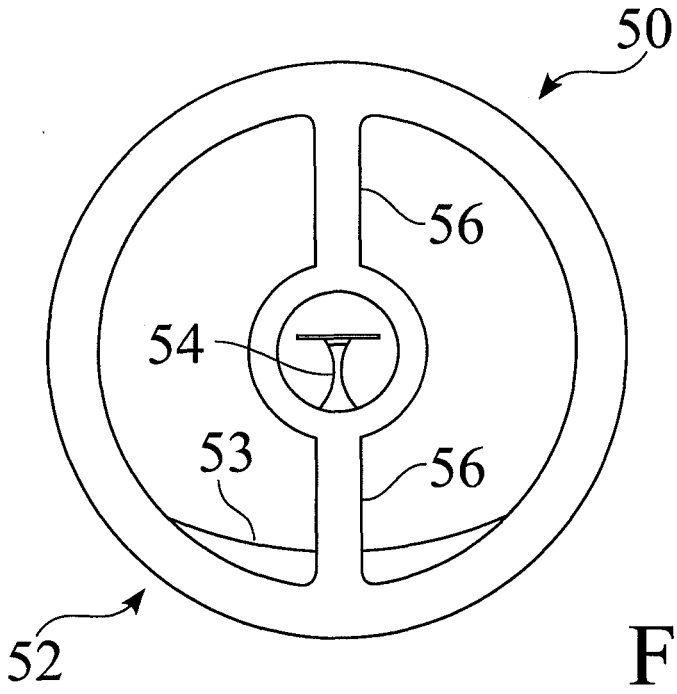
FIG. 5 is a side view showing a symmetrical spoke configuration of a low displacement pendulum having a knife-edge bearing, where a lower portion of the pendulum ring is thicker to create imbalance.

FIG. 5 is a side view showing a symmetrical spoke configuration 56 of a low displacement pendulum having a knife-edge bearing 54, where a lower portion 53 of the pendulum ring 52 is thicker to create imbalance in the ring 50.

Figure 6:
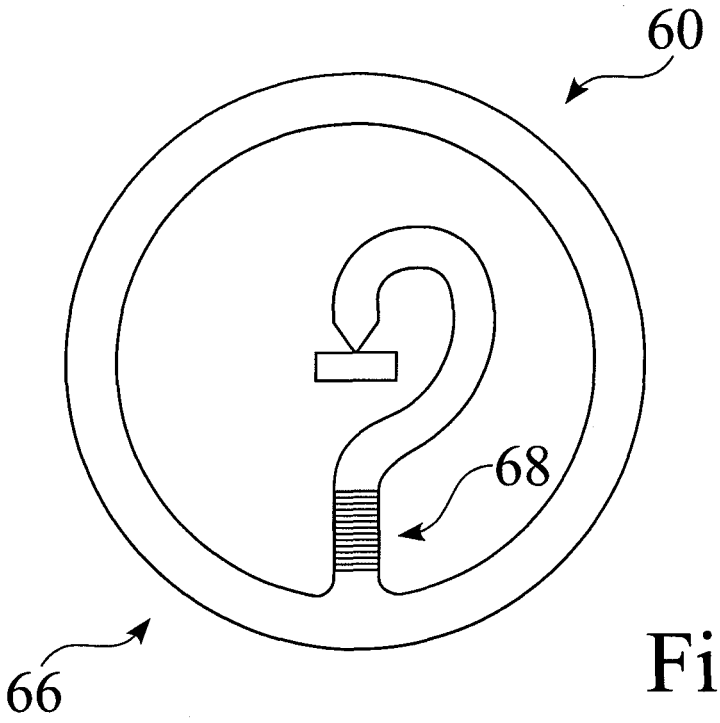
FIG. 6 is a side view showing a curved spoke configuration of a low displacement pendulum having downward compensation.

FIG. 6 is a side view showing a curved spoke configuration of a low displacement pendulum having downward compensation 66 in the ring 60.

The reduction of frictional and barometric errors, combined with simple thermal compensation, make the low-displacement pendulum an alternative to the conventional bob pendulum operated in air. The reduced power requirements and high Q suggest that the slower low-displacement pendulum has greater stability than a conventional pendulum. Whether or not it is more accurate, the reduced input power, reduced wear and simplification of the gear train associated with a longer period, make this an attractive pendulum. Initial experiments look promising. An 18-inch test pendulum, having periods of about three seconds, has a Q of several thousand, which compares favorably with conventional pendulums of the same size and weight.

Enhanced Compound Pendulums. Several embodiments of enhanced compound pendulums 100, e.g. 100*a* (FIG. 7) are also disclosed herein, which can be easily compensated, such as to provide thermal compensation and/or barometric compensation, without the use of exotic materials such as Invar™ or mercury. These enhanced compound pendulums 100 are simple to construct, and can be far more easily compensated than conventional, single-bob pendulums.

As noted above, compound pendulums generally have a longer period than a corresponding idealized pendulum, due to the extra moment of inertia contributed by the distribution of the mass. The enhanced compound pendulums 100 disclosed herein deliberately take advantage of this effect, by putting material above the point of rotation.

Figure 7:
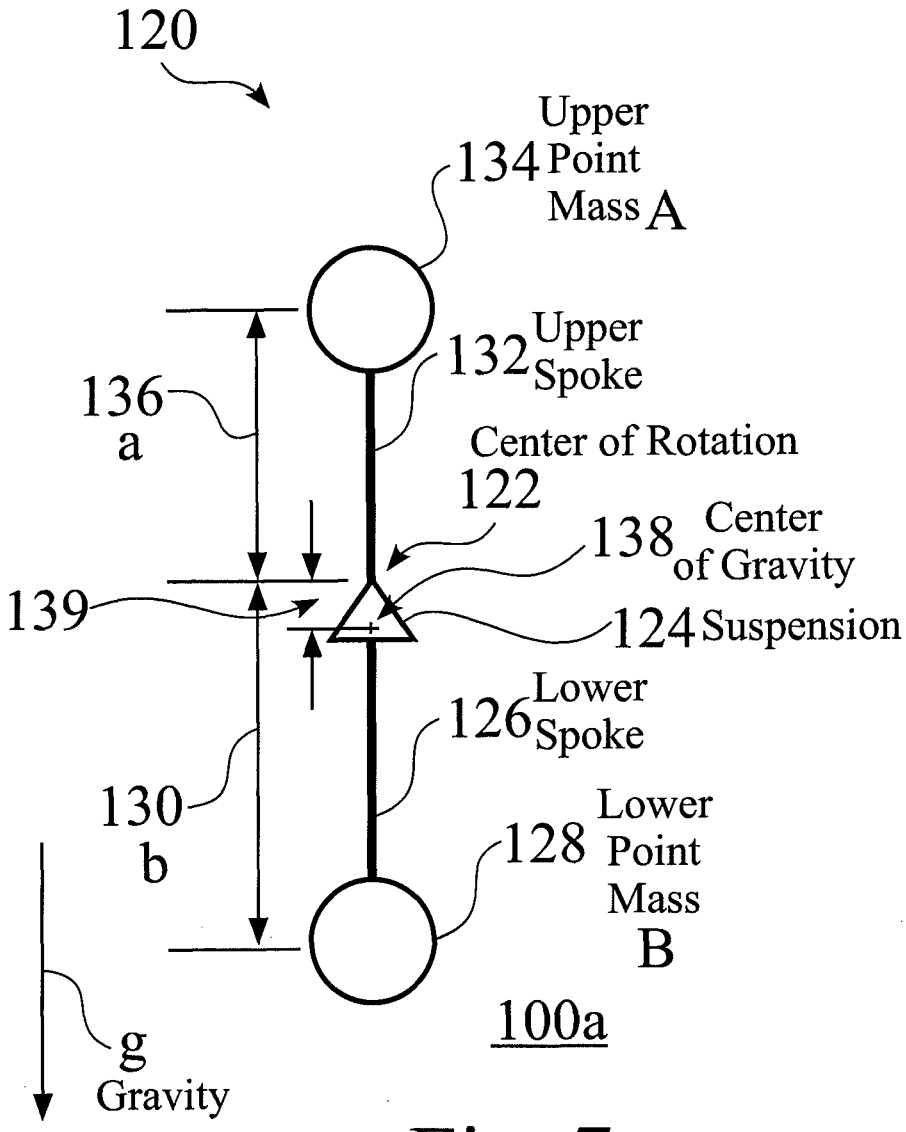
FIG. 7 is a schematic front view of a first exemplary embodiment of an enhanced compound pendulum.
Figure 8:
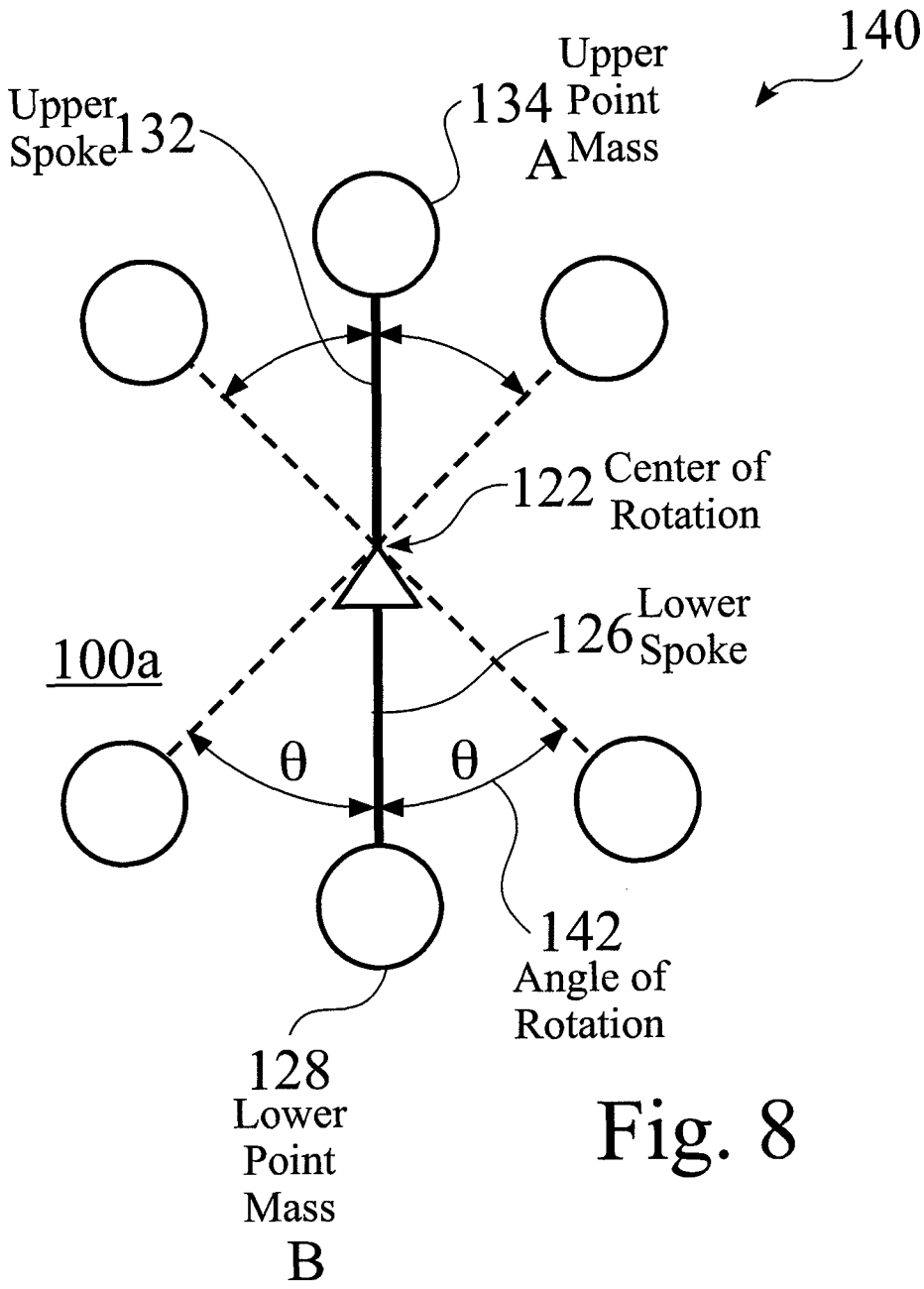
FIG. 8 shows exemplary rotational movement of a first exemplary embodiment of an enhanced compound pendulum.

FIG. 7 is a schematic front view 120 of a first exemplary embodiment of an enhanced compound pendulum 100*a*. FIG. 8 shows exemplary rotational movement 140 of a first exemplary embodiment of an enhanced compound pendulum 100*a*.

As seen in FIG. 7 and FIG. 8, two point masses, e.g. comprising an upper point mass A 134 and a lower point mass B 128, are located above and below the point of rotation 122, at distances a 136 and b 130, respectively.

The model applies to any compound pendulum with radius of gyration r and distance from center of rotation to center of gravity h, where $$r = \sqrt{\frac{Aa^2 + Bb^2}{A + B}} \tag{7}$$

and $$h = \frac{Bb - Aa}{A + B} \tag{8}$$

The angle of the pendulum θ changes with time according to Newton's equation $$\theta'' = -g\left(\frac{-Aa + Bb}{Aa^2 + Bb^2}\right)\mathrm{Sin}(\theta) \tag{9}$$

For small amplitudes, the solution to this equation is a sine wave with period $$p_c = 2\pi\sqrt{\frac{(Aa^2 + Bb^2)}{-(Aa + Bb)g}} \tag{10}$$

Or in terms of the distance to the center of gravity and the radius of gyration $$p = 2\pi\sqrt{\frac{r^2}{hg}} \tag{11}$$

Notice that if h=r (when upper point mass A=0) this reduces to the more familiar $$p = 2\pi\sqrt{\frac{r}{g}} \tag{12}$$

The period p remains constant as long as the ratio of force to inertia does not change. If the upper spoke 132 and lower spoke 126 are comprised of materials with coefficients of thermal expansion α and β, respectively, then a temperature change of ΔT will change the period to $$p = 2\pi\sqrt{\frac{(A(a(1+\alpha\Delta T))^2 + B(b(1+\beta\Delta T))^2}{(-Aa(1+\alpha\Delta T) + Bb(1+\beta\Delta T))g}} \tag{13}$$

This may be expanded as a Taylor series around ΔT=0 to $$p = p_c\left(1 - \frac{\begin{matrix} a^3A^2\alpha - 2a^2AbB\alpha - aAb^2B\alpha + \\ a^2AbB\beta + 2aAb^2B\beta + b^3B^2\beta \end{matrix}}{(aA - bB)(a^2A + b^2B)}\Delta T + o[\Delta T^2]\right) \tag{14}$$

By setting this ΔT term in the expansion to zero, the coefficient of thermal expansion α is given as:

$$\alpha = \frac{bB(-a^2A - 2aAb + b^2B)}{aA(a^2A - 2aBb - b^2B)}\beta. \tag{15}$$

Or in the case where a=b=r $$\alpha = \frac{2h^2 - hr - r^2}{2h^2 + hr - r^2}\beta \tag{16}$$

Therefore, the expansion factors for components of enhanced compound pendulums 100 may preferably be chosen to provide thermal compensation to the first order.

Figure 9:
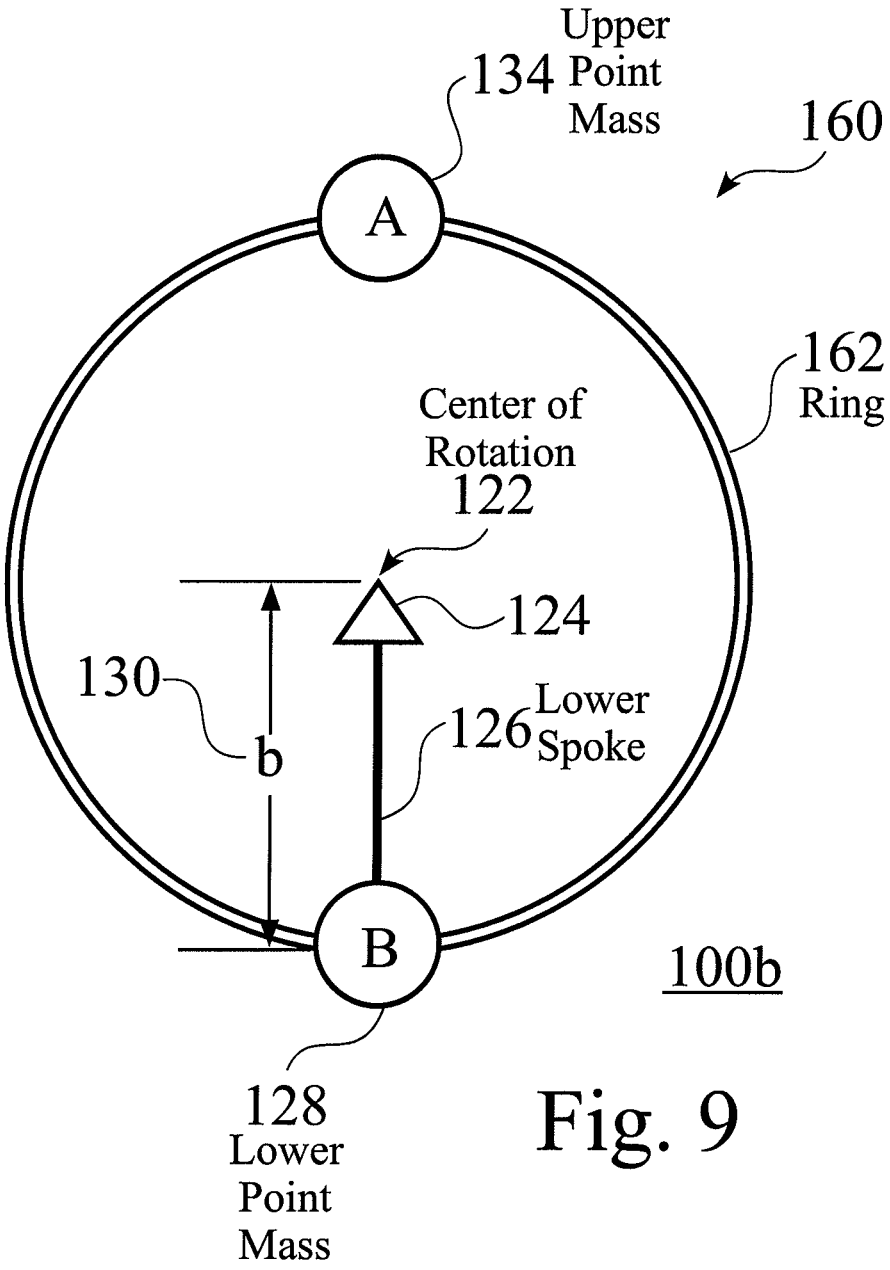
FIG. 9 is a schematic front view of a second exemplary embodiment of an enhanced compound pendulum having a ring and spoke structure.

FIG. 9 is a schematic front view 160 of a second exemplary embodiment of an enhanced compound pendulum 100*b*, having a ring and spoke structure, such as to provide the further advantages of a low displacement pendulum, as described above. As seen in FIG. 9, a lower arm 126 extends from the center of rotation 122 to a lower point mass 128, while an upper point mass 134 is mounted to the assembly 100*b* through a ring 162 that extends to the lower point mass 128, wherein the upper mass 134 is connected to the center of rotation through the lower mass 128, instead of directly to the point of rotation 122.

The exemplary enhanced compound pendulum 100*b* shown in FIG. 9 makes the thermal expansion factors for providing thermal compensation convenient. For example, assuming that the ring 162 hangs from the point of rotation 122 by a massless downward pointing spoke 126 of radius r and distance from the center of rotation to the center of gravity h, and that both the ring 162 and the spoke 126 have a coefficient of thermal expansion β, then the change in period accounting for temperature change is $$p = 2\pi\sqrt{\frac{(r(1+\beta\Delta T))^2}{h(1+\beta\Delta T)g}}. \tag{17}$$

Both the change due to temperature and period differ from the idealized pendulum by a factor of $$\sqrt{\frac{r}{h}}. \tag{18}$$

However, if the spoke 126 that has a coefficient of thermal expansion β is replaced by a spoke 126 that has a coefficient of thermal expansion α, then there is an additional shift of r(α−β)ΔT, wherein the period p is shown as $$p = 2\pi\sqrt{\frac{(r(1+\beta\Delta T))^2 + (r(\alpha-\beta)\Delta T)^2}{(h(1+\beta\Delta T) + r(\alpha-\beta)\Delta T)g}}. \tag{19}$$

The $(r(\alpha-\beta)\Delta T)^2$ term in the numerator is the extra inertia due to the parallel axis shift. Using the same Taylor series method used above, the enhanced compound pendulum 100*b* is thermally compensated, i.e. the ΔT term is zero, when $$\alpha = \frac{(r+h)}{r}\beta. \tag{20}$$

If h is small compared to r in this embodiment of an enhanced compound pendulum 100*b*, the two coefficients of thermal expansion β and α are similar in magnitude.

Figure 10:
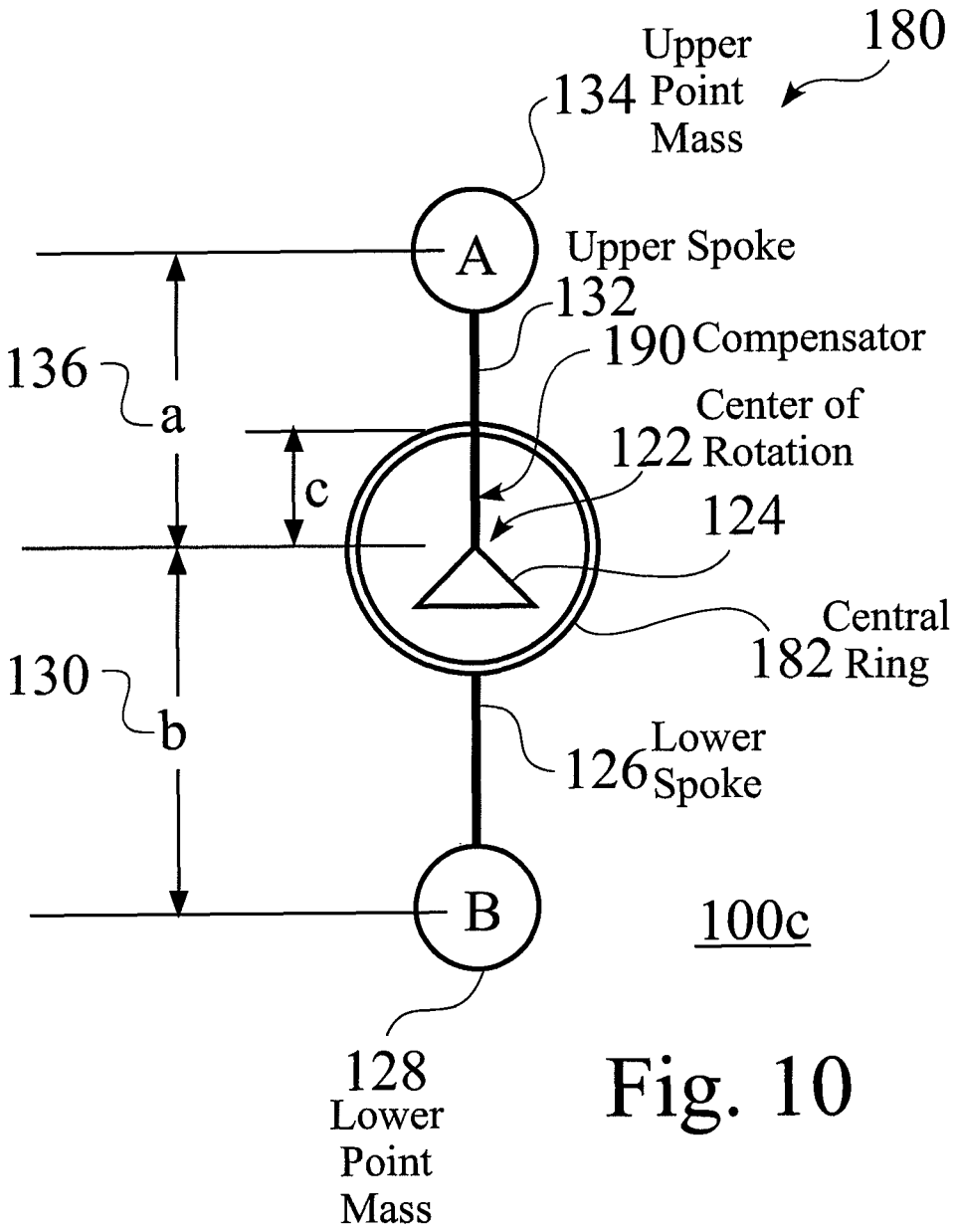
FIG. 10 is a schematic front view of a third exemplary embodiment of an enhanced compound pendulum having a ring and spoke structure, wherein a ring structure extends locally around a central compensator structure.

FIG. 10 is a schematic front view 180 of an alternate exemplary embodiment of an enhanced compound pendulum 100*c* having a ring and spoke structure, wherein a central member 182, e.g. a ring structure 182, extends locally around a central compensator structure 190. As seen in FIG. 10, the central ring 182 does not extend around the entire length of either the upper spoke 132 or the lower spoke 126.

In practice, the coefficient of the spokes 126,132 for some embodiments of the enhanced compound pendulum 100 can be tuned, by using a second material for only a portion of the length for one or both spokes 126,132, e.g. a portion of length b of the spoke 126, and/or a portion of the length a of the upper spoke 132. For example, a steel pendulum 100*c* can be thermally compensated with a short length of brass or aluminum replacing a portion of the steel upper spoke 132.

As seen in FIG. 10, the ring 182 does not extend around the entire spoke, but just around the compensator 190. Furthermore, the compensator 190 may preferably be comprised of a material that has either a higher or a lower thermal expansion than the rest of the pendulum 100, e.g. 100*c*. This is accomplished by using an upward pointing spoke in the case where the compensator 190 has lower thermal expansion, also shown in FIG. 10. In this case, the compensation occurs when $$\alpha = \frac{(r-h)}{r}\beta. \tag{21}$$

Figure 11:
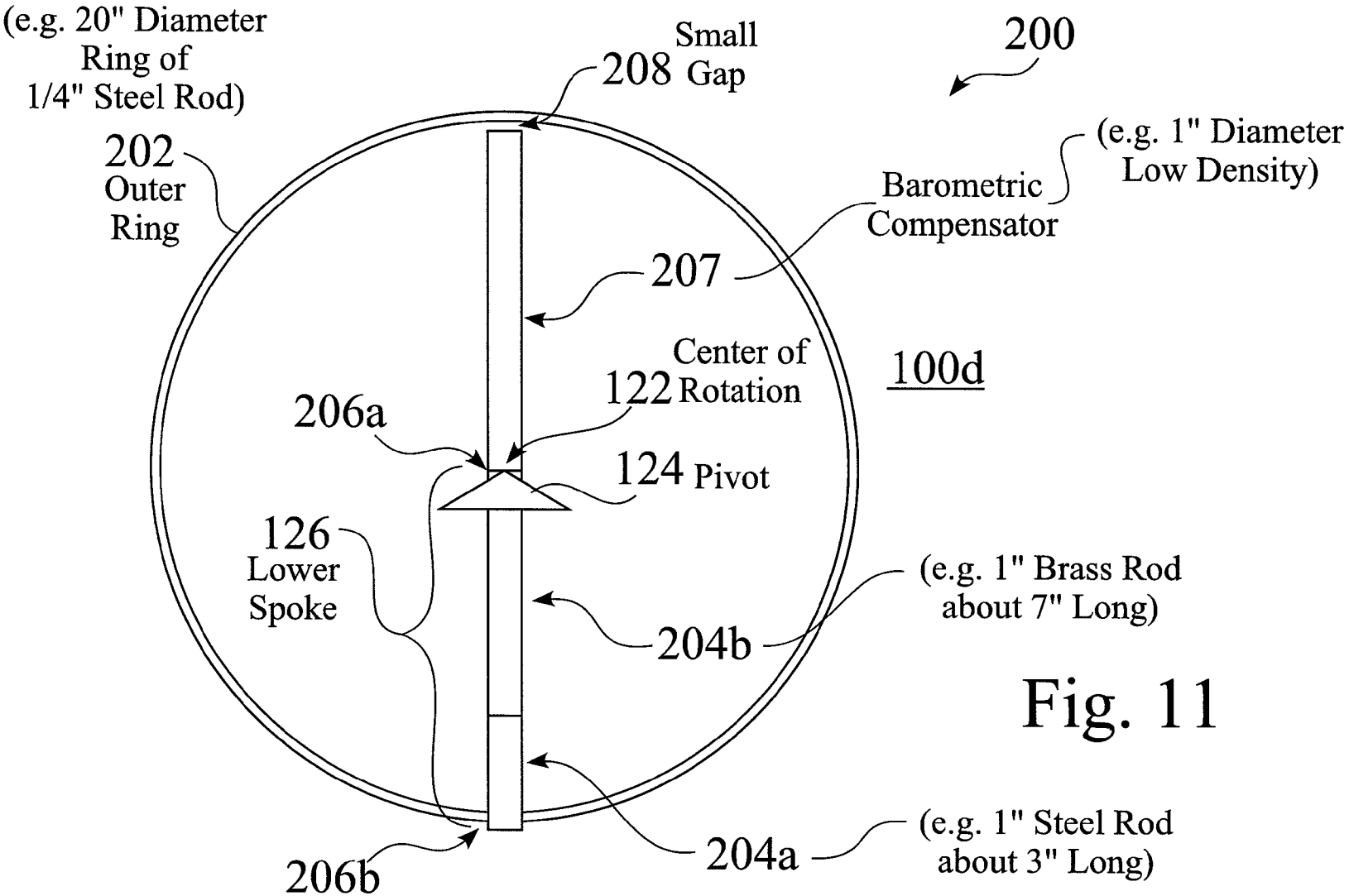
FIG. 11 is a detailed schematic view of an exemplary embodiment of an enhanced compound pendulum having a ring and spoke structure, wherein a peripheral ring extends from the lower spoke.

FIG. 11 is a detailed schematic view 200 of an exemplary embodiment of an enhanced compound pendulum 100*d* having a ring and spoke structure, wherein a peripheral ring 202 extends from the lower spoke 126. The lower arm 126 shown in FIG. 11 extends from a first end 206*a*, at the center of rotation 122, to a second lower end 206*b*.

In the exemplary embodiment 100*d* seen in FIG. 11, the outer peripheral ring 202 comprises a 20-inch diameter ring 202 of 0.25-inch diameter steel rod. The peripheral ring 202 is suspended from the pivot 122, by the downward pointing spoke 126. A portion 204*a* of the lower spoke 126 comprises 1-inch diameter medium carbon steel rod.

In the exemplary embodiment shown in FIG. 11, the mass of the ring and spoke themselves serve as the weights, wherein no additional bobs, e.g. a lower mass 128 and/or an upper mass 134, are used.

The required length of the compensator 207 may be determined by parameter h and r, which can be calculated or measured directly. For a ring 202 and bar portion 204*a* comprising medium carbon steel having a density of 0.284 lb/in$^3$ (7.86 g/cm$^3$), the total weight of the enhanced compound pendulum 100*d* is calculated to be approximately about 5.7 pounds.

The distance h, from the center of rotation 122 at the pivot 124, to the center of gravity h is about 2 inches. The period for the exemplary enhanced compound pendulum 100*d* is about 2 seconds. The radius of gyration r calculated from either the measured period or from the geometry is about 8.5 inches. Using the formulas above with β=15μ/° C., which is the thermal expansion coefficient of medium carbon steel, the required thermal expansion coefficient α of the lower spoke 126 is calculated as:

$$\alpha = \frac{r+h}{r}\beta = \frac{8.5+2}{8.5}15 \approx 18.5. \tag{22}$$

Since yellow brass has a thermal expansion coefficient of about 20μ/° C., a lower spoke 126 with the desired temperature coefficient of 18.5μ/° C. may preferably be provided, such as by replacing a section 204*b* about 7 inches for the 10-inch spoke 126 with brass. Since the density of brass is similar to that of steel, the parameters h and r change only slightly. In practice, the expansion coefficients are often not exact, such that the length of the compensator may preferably be tuned by experiment.

Therefore, some embodiments of enhanced compound pendulums may preferably provide thermal compensation for a pendulum by replacing at least a portion of a spoke 126 with one of higher thermal expansion. Expansion of the radius of gyration slows the pendulum, unless it is compensated by a greater force through the lengthening of h. In embodiments of enhanced compound pendulums 100, these two parameters can be controlled independently.

Figure 12:
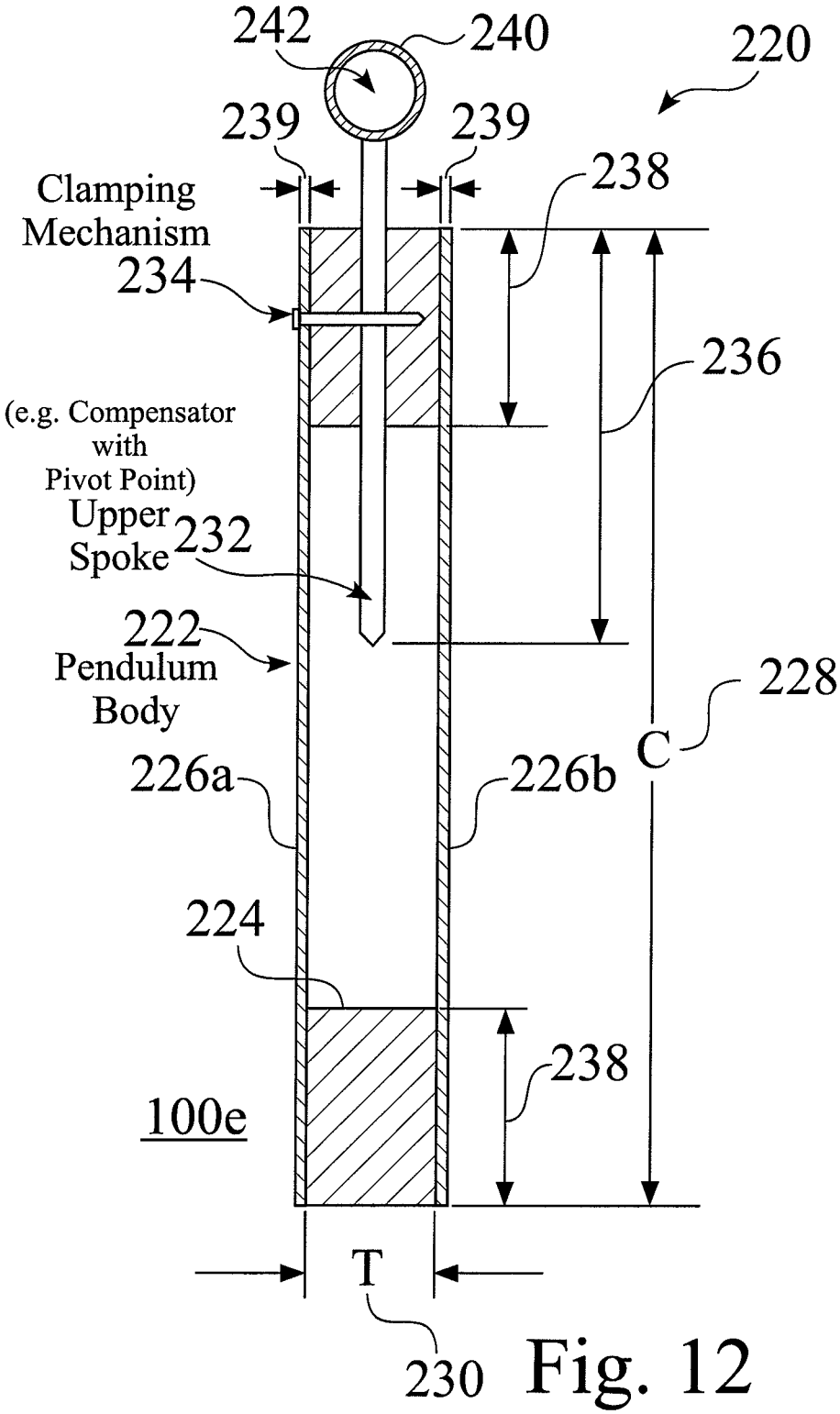
FIG. 12 is a schematic partial cutaway view of an enhanced compound pendulum having an upward pointing spoke that provides adjustable compensation.

FIG. 12 is a schematic partial cutaway view 220 of an enhanced compound pendulum 100*e* having an upward pointing spoke 232, wherein a large portion of the structure 100*e* is a pendulum body 222 comprised of brass. In an exemplary embodiment of the enhanced compound pendulum 100*e*, the upward pointing spoke 232 is comprised of steel, and serves as both a thermal compensator and a pivot 122.

In one specific embodiment of an enhanced compound pendulum 100*e, h* is about 1.4 inches, and is r about 7.3 inches, yielding a period of about 2 seconds. The exact period can be adjusted by changing the position of the spoke 232. The length 236 of the compensator 232 may preferably be adjusted by changing the position of the clamping mechanism 234, e.g. a clamping screw, which forms the contact with the compensator 232. In one embodiment, the clamping mechanism further comprises one or more washers that are pressable against the compensator bar 232. In some embodiments, the thickness of the material is the same for all parts, e.g. between central elements 224. In one specific embodiment, the overall pendulum height 228 is 20 inches, with central elements having a width 230 of 2.625 inches and a height 238 of 4 inches, front and rear face members 226*a*,226*b* each having a width 239 of ¼ inches, and an upper spoke compensator 232 having a 0.5 inch diameter and an initial height 236 of about 8.5 inches. For some embodiments of the exemplary enhanced compound pendulum 100*e* shown in FIG. 12, a barometric compensator element 240 may preferably be added to the top of the pendulum 100*e*, such as directly attached to the upper spoke 232, which may further comprise a hollow region 242 defined therein.

If the enhanced compound pendulum 100*e* is suspended by flexure, the variation in restoring force due to the change in stiffness of the flexure may preferably be taken into account. This is particularly important in a compound pendulum, because the restoring force is lower in proportion to the mass.

The speedup s can be calculated from the speedup equation shown in K. James. "The Design of Pendulum Springs for Pendulum Clocks", *Timecraft*, June-August 1983, which is incorporated herein. While the speedup s is typically less than one percent, its change with temperature can be a significant source of error.

For example, a compound pendulum that is suspended by a spring would have a temperature stiffness dependency of γ (typically negative), wherein the value γ takes into account both the change in dimensions of the spring and the (generally larger) change in Young's modulus, as described by A. Rawlings, *The Science of Clock and Watches*, Pitman Publishing, p. 144. For example, the value γ is about 200 parts per million per degree C. for spring steel, or about 300 ppm/C for Ti-6-4 titanium alloy, as noted in R. Boyer, G. Walsch, Materials Properties Handbook Titanium Alloys, ASM International, p. 493. For small s the period changes by sγΔT, as shown:

$$p = 2\pi(1+s+s\gamma\Delta T)\sqrt{\frac{(r(1+\beta\Delta T)^2+(r(\alpha-\beta)\Delta T)^2}{(h(1+\beta\Delta T)+(r(\alpha-\beta)\Delta T))g}}. \tag{23}$$

This is compensated when $$\alpha = \frac{(h+r+hs+rs)\beta-2hs\gamma}{r(1+s)}. \tag{24}$$

When both s and β are small this is approximately $$\alpha = \frac{(h+r)\beta-2hs\gamma}{r(1+s)}. \tag{25}$$

If the suspension spring has a coefficient of thermal expansion δ, when the thermal lengthening and effective length L of the spring (the length below the center of rotation) are also taken into account, then by a similar calculation $$\alpha = \frac{(h+r)\beta-2hs\gamma-L\delta}{(r-L)(1+s)}. \tag{26}$$

Or in the case of an upward spoke $$\alpha = \frac{(r-h)\beta+2hs\gamma+L\delta}{(r+L)(1+s)}. \tag{27}$$

The effective length L is typically ¾ of the actual length of the material, as noted in P. Woodward, "Some Thoughts on Suspension Springs", *Horological Journal,* 1998-5, pp. 3-6.

Finally, the variation of force due to barometric error (due to change in buoyancy) is dependent on the first moments of the volumes of the masses above and below the center, Va and Vb, $$\Delta F \propto \Delta P(bVb - aVa). \tag{28}$$

Some barometric compensators use an aneroid pressure-sensing element to adjust the distance b with changing air pressure, as noted in P. Woodward, *My Own Right Time*, Oxford University Press, p. 102. In a pendulum with mass above the point of rotation, the barometric error can be eliminated by balancing the first moments of the volume about the pivot. This can be accomplished by making the material above the pivot less dense, either by using a low-density material, or by building a sealed hollow chamber into the upper bob. For example, the pendulum will be barometrically compensated if the pendulum is geometrically symmetric about the pivot. It would be possible to build a similar compensator for a conventional pendulum, by attaching a bob of low-density material to the rod above the pivot point.

For instance in the example pendulum described above, barometric compensation can be accomplished by adding a symmetrical upward pointing spoke of a low-density material, such as a light wood or plastic. A thin-walled tube with sealed end caps would also serve the purpose. This 1-inch diameter compensator can be attached to the ring or to the spoke, but a small gap 208 may preferably be defined in this "false spoke" to allow the ring 202 to expand freely, as shown in FIG. 11.

By using the methods described, thermally and barometrically compensated pendulums can be easily constructed without the use of special low-expansion materials or devices such as aneroids.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. A thermally compensated pendulum having a point of rotation, comprising:

a first mass A having a corresponding center of mass that extends a first distance a above the point of rotation, wherein the first mass A has a first coefficient of thermal expansion α;

a second mass B having a corresponding center of mass that extends a second distance b below the point of rotation, wherein the second mass B has a second coefficient of thermal expansion β;

wherein the first coefficient of thermal expansion α is given as:

$$\alpha = \frac{bB}{aA}\frac{(-a^2A - 2aAb + b^2B)}{(a^2A - 2aBb - b^2B)}\beta.$$

2. The pendulum of claim 1, wherein the first distance a and the second distance b are equal to a radius r, wherein h is the distance from the point of rotation to the center of gravity, and wherein the first coefficient of thermal expansion is further defined by $$\alpha = \frac{2h^2 - hr - r^2}{2h^2 + hr - r^2}\beta.$$

3. A compound pendulum having a point of rotation and a center of gravity, comprising:

an upper mass A above the point of rotation;

a lower mass B below the point of rotation;

a connecting member connected between the upper mass A and the lower mass B, wherein the connecting member has a first coefficient of thermal expansion α; and a spoke connected below the point of rotation to the connecting member and extending to the point of rotation, wherein the spoke has a second coefficient of thermal expansion β;

wherein h is the distance from the point of rotation to the center of gravity, wherein r is the radius about the point of rotation, and wherein the ratio of the first coefficient of thermal expansion α to the second coefficient of thermal expansion β is approximately given as:

$$\frac{\alpha}{\beta} = \frac{(h+r)}{(r)}.$$

4. The compound pendulum of claim 3, wherein the first coefficient of thermal expansion α is greater than the second coefficient of thermal expansion β.

5. The compound pendulum of claim 3, wherein the connecting member comprises a ring.

6. The compound pendulum of claim 3, wherein at least a portion of the spoke further comprises a compensator having a thermal expansion coefficient greater than the second coefficient of thermal expansion β.

7. A compound pendulum having a point of rotation and a center of gravity, comprising:

an upper mass A above the point of rotation;

a lower mass B below the point of rotation;

a connecting member connected between the upper mass A and the lower mass B, wherein the connecting member has a first coefficient of thermal expansion α; and a spoke connected above the point of rotation to the connecting member and extending to the point of rotation, wherein the spoke has a second coefficient of thermal expansion β;

wherein h is the distance from the point of rotation to the center gravity, wherein r is the radius about the point of rotation, and wherein the ratio of the first coefficient of thermal expansion α to the second coefficient of thermal expansion 62 is approximately given as:

$$\frac{\alpha}{\beta} = \frac{(r-h)}{(r)}.$$

8. The compound pendulum of claim 7, wherein the first coefficient of thermal expansion α is less than the second coefficient of thermal expansion β.

9. The compound pendulum of claim 7, wherein the connecting member comprises a ring.

10. The compound pendulum of claim 7, wherein at least a portion of the spoke further comprises a compensator having a thermal expansion coefficient less than the second coefficient of thermal expansion β.

* * * * *